US008337076B2

(12) United States Patent
Calabrese

(10) Patent No.: US 8,337,076 B2
(45) Date of Patent: Dec. 25, 2012

(54) TOURBILLON AND TIMEPIECE MOVEMENT INCLUDING THE SAME

(75) Inventor: Vincent Calabrese, Lausanne (CH)

(73) Assignee: Blancspain S.A., Le Brassus (CH)

( * ) Notice: Subject to any disclaimer, the term of this patent is extended or adjusted under 35 U.S.C. 154(b) by 234 days.

(21) Appl. No.: 12/911,333

(22) Filed: Oct. 25, 2010

(65) Prior Publication Data

US 2011/0096635 A1 Apr. 28, 2011

(30) Foreign Application Priority Data

Oct. 26, 2009 (EP) ..... 09174080

(51) Int. Cl.
*G04B 15/00* (2006.01)

(52) U.S. Cl. ..... 368/127; 368/142

(58) Field of Classification Search ..... 368/127–133, 368/140, 142

See application file for complete search history.

(56) References Cited

U.S. PATENT DOCUMENTS

| | | | | |
|---|---|---|---|---|
| 7,527,423 | B2 * | 5/2009 | Ruchonnet et al. | 368/127 |
| 7,946,755 | B2 * | 5/2011 | Greubel et al. | 368/127 |
| 2006/0221775 | A1 * | 10/2006 | Zaugg | 368/127 |
| 2008/0074955 | A1 | 3/2008 | Golay et al. | |
| 2008/0144447 | A1 * | 6/2008 | Ruchonnet et al. | 368/127 |
| 2010/0091617 | A1 * | 4/2010 | Goeller et al. | 368/127 |
| 2011/0019505 | A1 * | 1/2011 | Kapshitzer | 368/127 |

FOREIGN PATENT DOCUMENTS

EP 1 903 408 A2 3/2008

* cited by examiner

*Primary Examiner* — Sean Kayes
(74) *Attorney, Agent, or Firm* — Sughrue Mion, PLLC

(57) ABSTRACT

The tourbillon mechanism is characterized in that it includes a toothed wheel (127; 227) and at least two toothed elements (125A, 125B; 225A, 225B, 225C) pivoting in the carriage (103), the toothed wheel, which meshes with the escape pinion (111 B), being freely mounted in the carriage in a coaxial position, and said at least two toothed elements (125A, 125B; 225A, 225B, 225C) being regularly spaced around said toothed wheel (127; 227) with which said toothed elements mesh, said at least two toothed elements each being designed to mesh with the fixed toothing (119; 219), so as to connect the escape pinion to the fixed toothing.

8 Claims, 6 Drawing Sheets

TOURBILLON AND TIMEPIECE MOVEMENT INCLUDING THE SAME

This application claims priority from European Patent Application No. 09174080.3 filed Oct. 26, 2009, the entire disclosure of which is incorporated herein by reference.

FIELD OF THE INVENTION

The present invention concerns a timepiece mechanism including an escapement comprising an escape wheel and pinion and a sprung balance, the escapement and the sprung balance being mounted in a rotating carriage designed to pivot on the frame of a timepiece movement fitted with a driving barrel, and to be driven in rotation by said driving barrel, and further including a circular toothing, called a fixed toothing, designed to be secured to the frame in a concentric position relative to the axis of rotation of the carriage, the escape pinion being provided for connection to said fixed toothing via a gear.

A mechanism matching the above definition is commonly called a tourbillon.

The present invention also concerns a timepiece movement including a driving barrel, an escapement including an escape wheel and pinion, and a sprung balance, the escapement and the sprung balance being mounted in a carriage that pivots on a frame of the timepiece movement and kinematically connected to the driving barrel, such that the carriage can be driven in rotation, the escape pinion being connected via a gear to a fixed circular toothing integral with the frame, said fixed toothing being concentrically arranged with the axis of rotation of the carriage.

A timepiece movement matching the above definition is commonly called a tourbillon watch movement.

STATE OF THE ART

Tourbillon watch mechanisms that match the definition given in the above preamble are known. The purpose of the tourbillon is to compensate for variations of rate correlated with the vertical position in which the watch is held.

In an ideal watch, the centre of gravity of the sprung balance system should be located on the axis of rotation and kept there permanently during oscillations. When the real behaviour of the sprung balance system does not conform to this ideal, variations of rate are observed, which depend upon the orientation of the watch relative to the vertical. Indeed, the effect of the earth's gravity is to return the centre of gravity of the sprung balance system downwards. Thus, when the balance staff is not in a vertical position, the gravitation pull generates a variable torque, which acts on the balance and alters the intensity of the torque generated by the elasticity of the balance spring. This phenomenon is the essential cause of variations of rate between the vertical positions of the watch.

The function of the tourbillon is to make the escapement-balance assembly turn on itself so that the latter takes all positions, in order to average out variations of rate. It will thus be clear that the purpose of the tourbillon is not to remove differences between the vertical positions, but to compensate for said differences.

FIG. 1, reproduced from the www.horlogerie-suisse.com website, illustrates a known tourbillon. Tourbillon 1 includes a rotating carriage 3, which is coaxially fixed to the arbour of a pinion 15, and which is mounted to rotate with said pinion between two bearings 5, 6. Carriage 3 carries a device formed of a sprung balance 9 and a lever assortment 11A, 12, 13. It can be observed that, in the illustrated tourbillon, sprung balance 9 is coaxially mounted with carriage 3. It will, however, be clear that the sprung balance could equally be carried by carriage 3 in an off-centre position.

The pinion of carriage 15 is connected to a barrel (not shown) via the going train of the watch (of which only the third wheel 17 is visible in the Figure). The barrel encloses a mainspring, designed to drive the gear train and the tourbillon. As is usual, the tourbillon of FIG. 1 occupies the place which would be assigned to the seconds-wheel in the going train of a watch with no tourbillon. This is why the pinion of carriage 15 is often called the seconds-pinion.

FIG. 1 also shows a fixed toothed wheel 19, in the form of a crown, which is adjusted and secured to a bottom plate 21 in a concentric position relative to the axis of rotation of carriage 3. It can also be seen that the teeth of fixed wheel 19 penetrate between the leaves of escape pinion 11B carried by the carriage so as to form a gear. Since fixed wheel 19 meshes with escape pinion 11B, said fixed wheel is sometimes called the seconds-wheel.

Carriage 3 is subject to the drive force acting on the pinion of carriage 15. In reaction, fixed tooth 19 exerts a force in the opposite direction on escape pinion 11B. Thus, in a tourbillon watch, as in a conventional watch, the escapement receives the energy originally distributed by the barrel. Inside carriage 3, the role of the escapement is conventional and it will be clear that the escapement can regulate the rotational speed of the carriage via pinion 11B, which meshes with fixed wheel 19 like a planetary wheel. It will be clear that when the watch is in a vertical position, the carriage occupies in succession all of the vertical positions during its rotation. Vertical error is thus averaged out.

The tourbillon theoretically has the advantage of compensating for the variations of rate between vertical positions. However, a study carried out by the Applicant shows that this advantage is often cancelled out by fluctuations in the transmitted energy. These fluctuations are caused by play in the center distance of the escape pinion and the fixed wheel. This play is due to the use of conventional pivots, in which the pivot is held in the bearing with some lateral slackness, to make a planetary type gear.

FIGS. 2A, 2B and 2C show schematically the relative positions of fixed wheel 19 and escape pinion 11B in three vertical positions of carriage 3 (not shown in FIG. 2). To give an illustrative example, it will be assumed that the two pivots 23A, 23B of carriage 3 (FIG. 1) have a diameter of 0.20 mm and that the hole in bearings 5, 6 (FIG. 1) is 0.21 mm. It will also be assumed, by way of example, that the pivots of the escape wheel set have a diameter of 0.09 mm and that the bearings have 0.10 mm holes. It will further be assumed that, in the horizontal position of the watch, the fixed wheel and the carriage are perfectly concentric, and the center distance "a" between fixed wheel 19 and escape pinion 11B has a value of 3.50 mm.

FIG. 2A shows escape pinion 11B and fixed wheel 19, side by side in a first vertical position of the carriage. In this position, the pivot axes of the carriage and the escapement are in the same horizontal plane. As the fixed wheel is integral with the bottom plate 21, it is not affected by the vertical position. However, in the vertical position, under the influence of gravity, the carriage shifts 0.005 mm downwards relative to the centre of the fixed wheel (these 0.005 mm equate to the slackness of the carriage pivots in their bearing). As the bearings that hold the escape pinion are mounted in the carriage, they follow the movement and also shift downwards parallel to the axis of the carriage. The escape wheel set will also shift 0.005 mm downwards in its bearing, which has also shifted. Finally, it is observed that the axis of the escape wheel set shifts 0.010 mm relative to the centre of the fixed wheel. However, as this shift is practically perpendicular to the plane containing the two axes, it has virtually no effect on the value of center distance $a_1$.

FIG. 2B shows escape pinion 11B directly underneath fixed wheel 19, in what is a second vertical position of the carriage. As explained with reference to FIG. 2A, in a vertical position, the escape pinion axis shifts 0.01 mm downwards relative to the centre of the fixed wheel. As in this example, the escape pinion is vertical to the fixed wheel; the amplitude of the shift thereof is added to the value of the center distance between the escape pinion and the fixed wheel. Thus in this example, the center distance $a_2$ has a value of 3.51 mm, and penetration of the fixed wheel teeth between the leaves of the escape pinion decreases by 0.01 mm. This decrease in penetration may lead to a gear defect known by the name of "butting", which is manifested as a decrease in transmitted force or even as the gear train becoming locked.

FIG. 2C shows the escape pinion 11B directly above fixed wheel 19, in what is a third vertical position of the carriage. In this latter case, the escape pinion is vertical to and directly above the fixed wheel. Thus, the pinion's downward shift reduces the value of the center distance between the escape pinion and the fixed wheel. In this example, the center distance $a_3$ has a value of 3.49 mm, which corresponds to an increase of 0.01 mm in penetration by the teeth of the fixed wheel between the leaves of the escape pinion. This increase may lead to a gear defect known by the name of "drop" which is manifested as an increase in the transmitted force and irregular speed.

In short, the tourbillon can compensate for variations of rate linked to the vertical position in which the watch is held. However, the tourbillon may itself cause rate instability. This instability results from the fact that the rate of a tourbillon watch tends to vary with the orientation of the carriage relative to the vertical.

The tourbillon described in the preceding example is a conventional tourbillon which pivots between two bearings 5 and 6. Flying tourbillons are also known in which the carriage is mounted on a single pivot that supports said carriage by the base thereof. With this type of arrangement, it is possible to omit the top bearing and the bridge on which the bearing is mounted, such that the top of the carriage is entirely free. In a vertical position of the watch, the tourbillon carriage overhangs, and gravity thus tends to incline the axis of the carriage downwards. If there is significant play around the single bearing, the inclining will be sufficient also to influence the penetration of the fixed wheel teeth between the leaves of the escape pinion.

BRIEF DESCRIPTION OF THE INVENTION

It is an object of the present invention to overcome the defects of tourbillons that have just been described. The present invention achieves this object by providing, either a timepiece mechanism that conforms to claim 1, or a timepiece movement that includes such a timepiece mechanism.

According to the present invention, instead of directly meshing with the escape pinion, the fixed toothing meshes with said at least two toothed elements. Said toothed elements are regularly spaced apart along the circumference of the fixed toothing and they mesh in turn with the toothed wheel which they surround. Finally, it is the toothed wheel that meshes with the escape pinion. Thus, the connection between the fixed toothing and the escape pinion is achieved by a gear including the fixed toothing, said at least two toothed elements, the toothed wheel and, finally, the escape pinion. Since it is not the fixed toothing, but rather the toothed wheel that meshes with the escape pinion, we will call the toothed wheel the "false" fixed wheel. It will be clear that the false fixed wheel is placed just above and approximately within the axis of the fixed toothing.

It will be clear that, since, according to the invention, the false fixed wheel is mounted in the carriage like the escape pinion, the center distance between these two wheels is not influenced by any play that exists in the pivoting of the carriage. Conversely, the center distance between each of said at least two toothed elements and the fixed toothing are liable to change in accordance with the orientation of the carriage relative to the vertical. However, since said at least two toothed elements are regularly spaced along the circumference of the fixed toothing, any reduction in the value of one of the center distances is approximately compensated for by the concomitant increase in the value of at least one other center distance, and vice versa. This phenomenon considerably reduces the variation of rate that accompanies the rotation of the tourbillon carriage when the watch is in a vertical position.

According to a particular embodiment of the present invention, the fixed toothing is formed by the toothing of a wheel secured to the frame.

According to an advantageous variant of this embodiment, the false fixed wheel and the wheel secured to the frame (the fixed wheel) have the same pitch radius and therefore rotate at the same speed. It will be clear that, since the wheel secured to the frame does not rotate, the false fixed wheel does not rotate either relative to the frame. This feature means that, for the tourbillon according to this embodiment, an escapement operating at the same speed as that of a conventional tourbillon can be used.

It is also possible for the fixed wheel and the false fixed wheel to have the same number of teeth. In these conditions, each of said at least two toothed elements can be a pinion.

According to another advantageous embodiment of the present invention, said at least two toothed elements regularly spaced around the false fixed wheel are two toothed elements occupying diametrically opposite positions. This variant allows the number of toothed elements to be limited to two, and thus simplifies the design of the tourbillon.

BRIEF DESCRIPTION OF THE DRAWINGS

Other features and advantages of the present invention will appear upon reading the following description, given solely by way of non-limiting example, and made with reference to the annexed drawings in which.

DETAILED DESCRIPTION OF AN EXAMPLE EMBODIMENT

Figure 1:
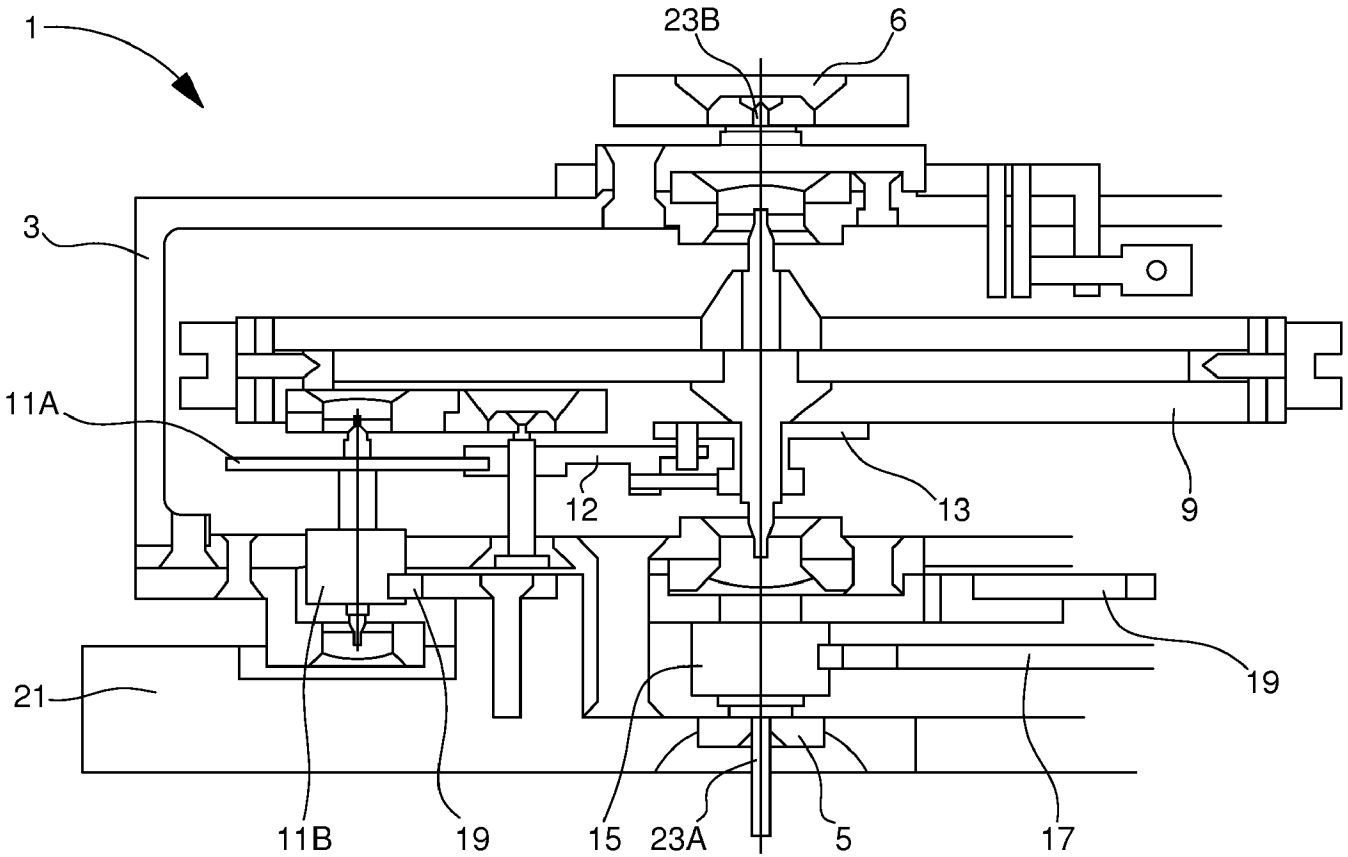
Fig. 1 Prior Art
FIG. 1 is a partial cross-section of a tourbillon watch mechanism of the prior art.
Figure 2A:
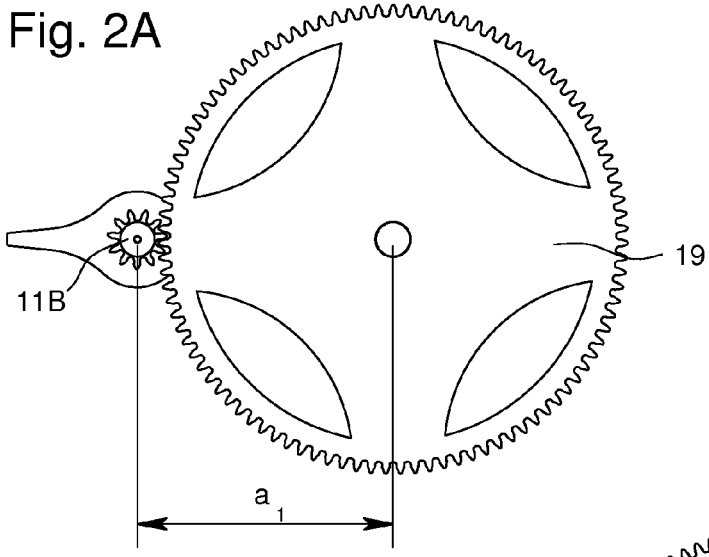
FIGS. 2A, 2B and 2C are schematic diagrams illustrating the relative positions of the fixed wheel and the escape pinion corresponding to three vertical positions of the carriage of a tourbillon watch mechanism of the prior art.
Figure 2B:
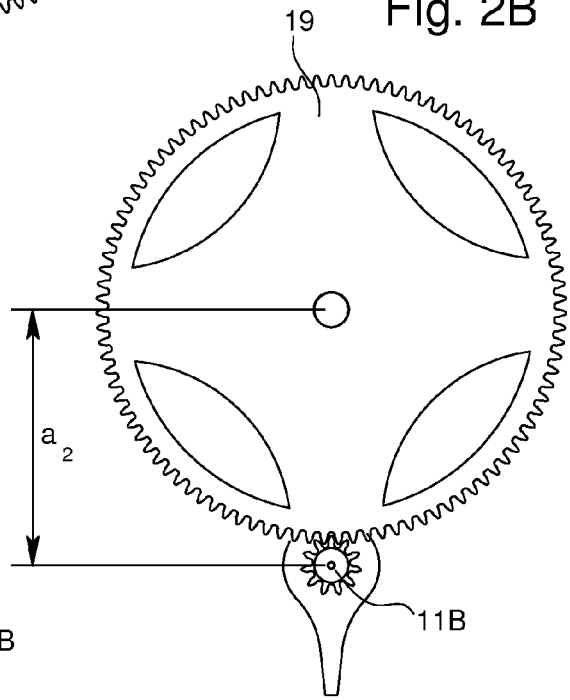
Figure 2C:
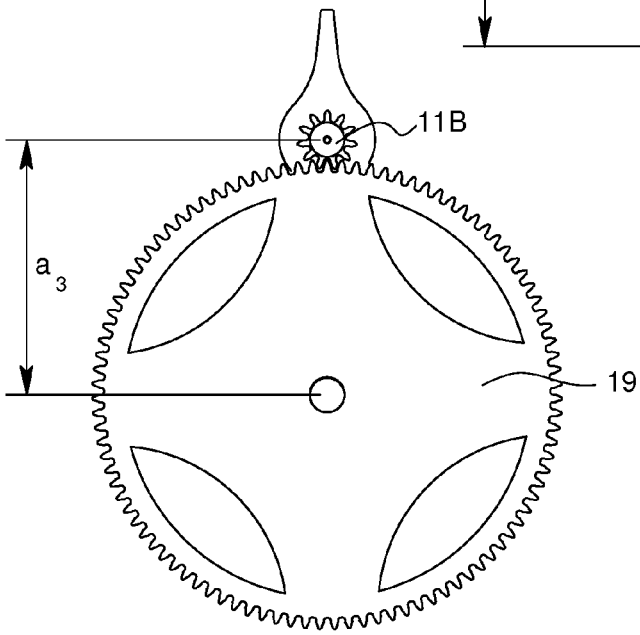
Figure 3:
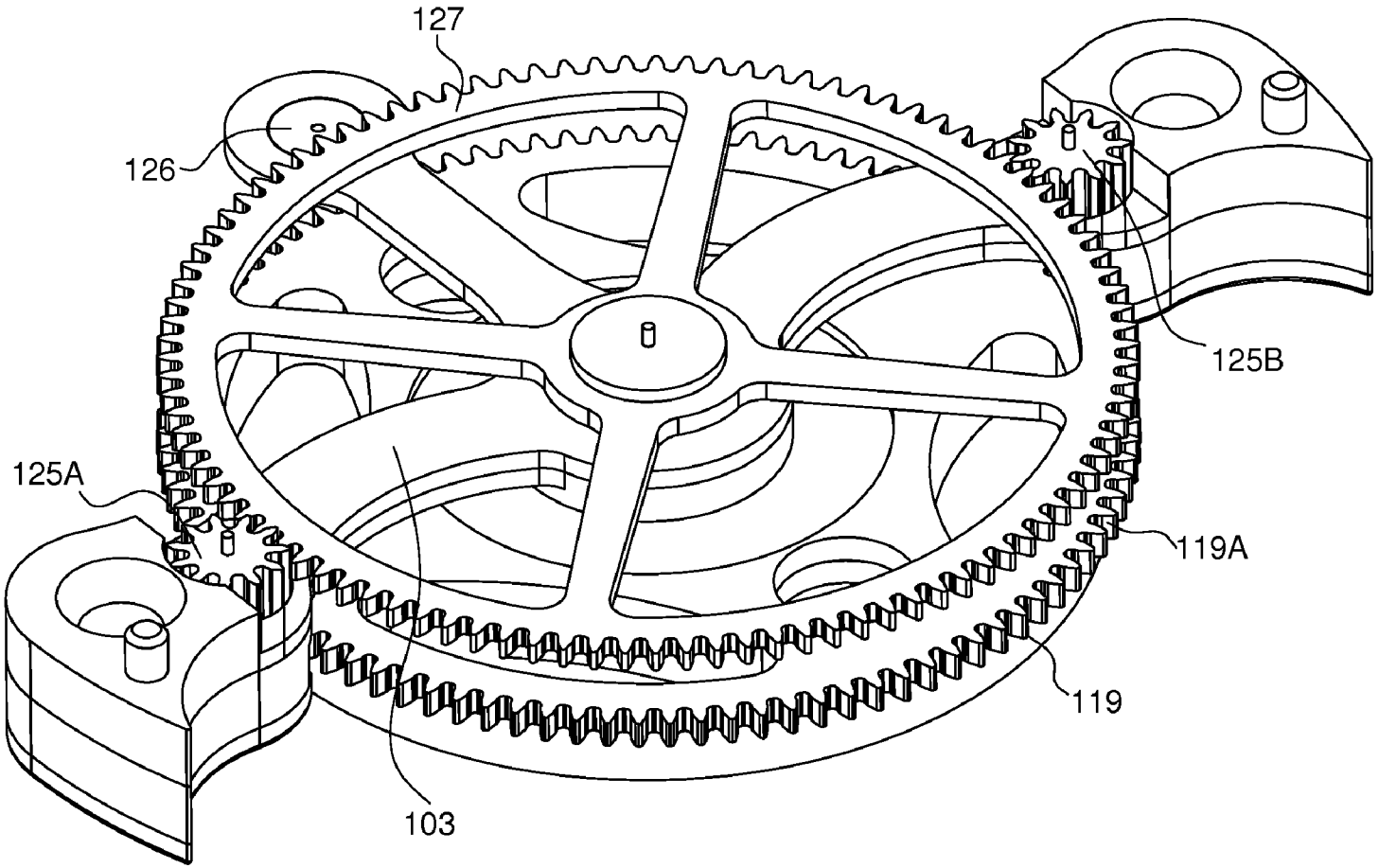
FIG. 3 is a partial perspective view showing a fixed wheel and the bottom part of the carriage of a tourbillon watch mechanism according to a first embodiment of the invention.

FIG. 3 is a partial perspective view of a tourbillon watch mechanism showing the fixed toothing and the bottom part of the rotating carriage. The Figure shows a fixed wheel 119A whose toothing forms the fixed toothing. The fixed wheel 119A is designed to be adjusted and secured to the frame of a timepiece movement (not shown). A bearing (not shown), for example a ball bearing, is arranged in the hub of the fixed wheel. Passing through this bearing there is the arbor of a pinion 115 (not shown), which is arranged to rotate in a space that exists underneath the fixed wheel, between the fixed wheel and the plate. Rotating carriage 103, only the bottom part of which is shown in FIG. 3, is coaxially fixed to the arbor of pinion 115 with which it is integral. In order to allow carriage 103 to be driven in rotation, pinion 115 (called the carriage pinion) is designed to be kinematically connected to the barrel of a timepiece movement (not shown) by the going train of the watch (not shown).

The carriage 103 carries two pinions 125A, 125B. These two pinions pivot in the carriage and occupy diametrically opposite positions on either side of fixed wheel 119A. Although this is not shown in the perspective view, the leaves of pinions 125A, 125B mesh with the fixed toothing. Carriage 103 further carries a wheel 127 (hereinafter the "false fixed wheel"), which has the same diameter and same number of teeth as the fixed wheel. The false fixed wheel pivots at the centre of the carriage concentrically with the arbour of pinion 115. It can also be seen that the two pinions 125A, 125B also mesh with wheel 127. It is thus clear that in the illustrated example the two pinions operate like intermediate wheels inserted between wheel 119A and wheel 127. These two wheels will thus rotate at the same speed, and since fixed wheel 119A is fixed to the frame of the timepiece movement, wheel 127 (the false fixed wheel) rotates at zero speed relative to the frame.

FIG. 3 also shows that the bottom part of carriage 103 carries at the periphery thereof a bearing 126, which is designed to receive the bottom end of the pivot of the escape wheel set (not visible in FIG. 3).

In addition to the elements described above with reference to FIG. 3, FIG. 4 shows a first bridge 129 of carriage 103. Bridge 129 carries a bearing 131 designed to receive the bottom end of the sprung balance staff (not visible in FIG. 4). It can be observed that, in the present example, the sprung balance pivots in the carriage in an off-centre position.

However, those skilled in the art will understand that the present invention applies equally to tourbillon watch mechanisms in which the sprung balance is carried by the carriage in a coaxial position. It can also be seen that the first bridge 129 further carries three other bearings (unreferenced). A centre bearing which is provided for the top end of the pivot of wheel 127 and two lateral bearings for receiving the top ends of the pivots of the two pinions 125A, 125B.

Figure 4:
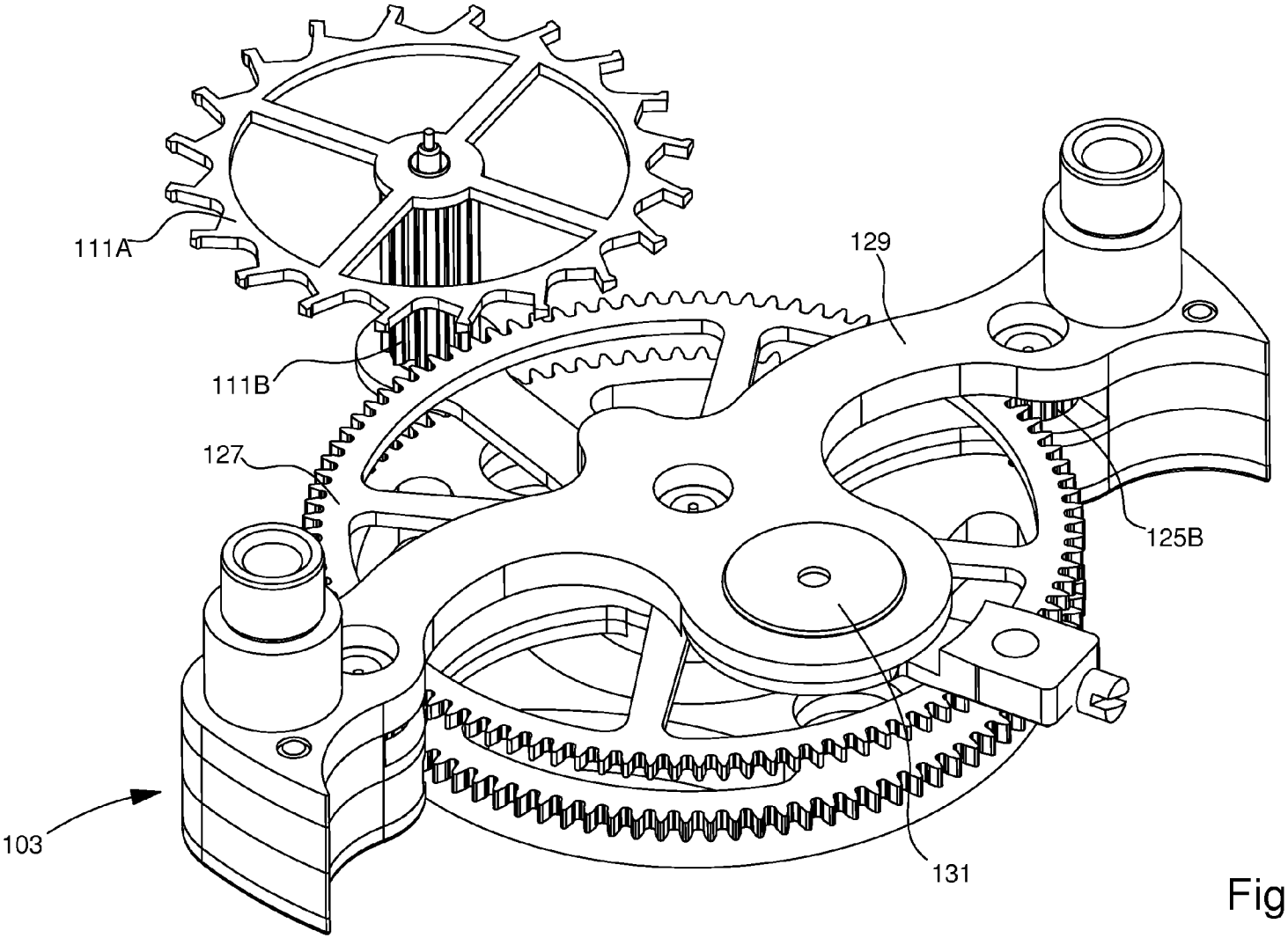
FIG. 4 is a partial perspective view of the fixed wheel and the carriage of FIG. 3, showing, in particular, the escape wheel set mounted in the carriage.

FIG. 4 also shows the escape wheel set formed by the escape pinion 111B and escape wheel 111A. The Figure shows that the leaves of pinion 111B penetrate between the teeth of wheel 127. It will be clear that when the tourbillon watch mechanism is operating, the escape wheel set moves like a planet around wheel 127. Since it is not possible for the false fixed wheel to rotate relative to the frame, the toothing thereof exerts a reaction force in the opposite direction to the planetary rotation of escape pinion 111B. The false fixed wheel thus plays exactly the same part as the fixed wheel of a tourbillon watch movement of the prior art. However, according to the present invention, the false fixed wheel and the escape wheel are both carried by carriage 103. Thus, in a timepiece mechanism according to the present invention, the force of gravity acting on the carriage does not affect the value of the center distance between the false fixed wheel and the escape wheel set.

With reference again to FIG. 3, it is understandable that the center distance between the fixed wheel 119A, on the one hand, and the two pinions 125A, 125B, on the other hand, are liable to vary depending upon the momentary orientation of the carriage relative to the vertical. However, since pinions 125A and 125B occupy diametrically opposite positions relative to fixed wheel 119A, any variation in the distance of centre between the fixed wheel and one of the pinions is compensated for by an opposite variation in the distance of centre between the fixed wheel and the other pinion. Thus, when a center distance variation causes, the force transmitted to one of the pinions to decrease, the force transmitted to the other pinion increases, and vice versa. It will be clear, therefore, that the fact of having at least two regularly spaced pinions allows the transmitted force to be averaged out.

Figure 5:
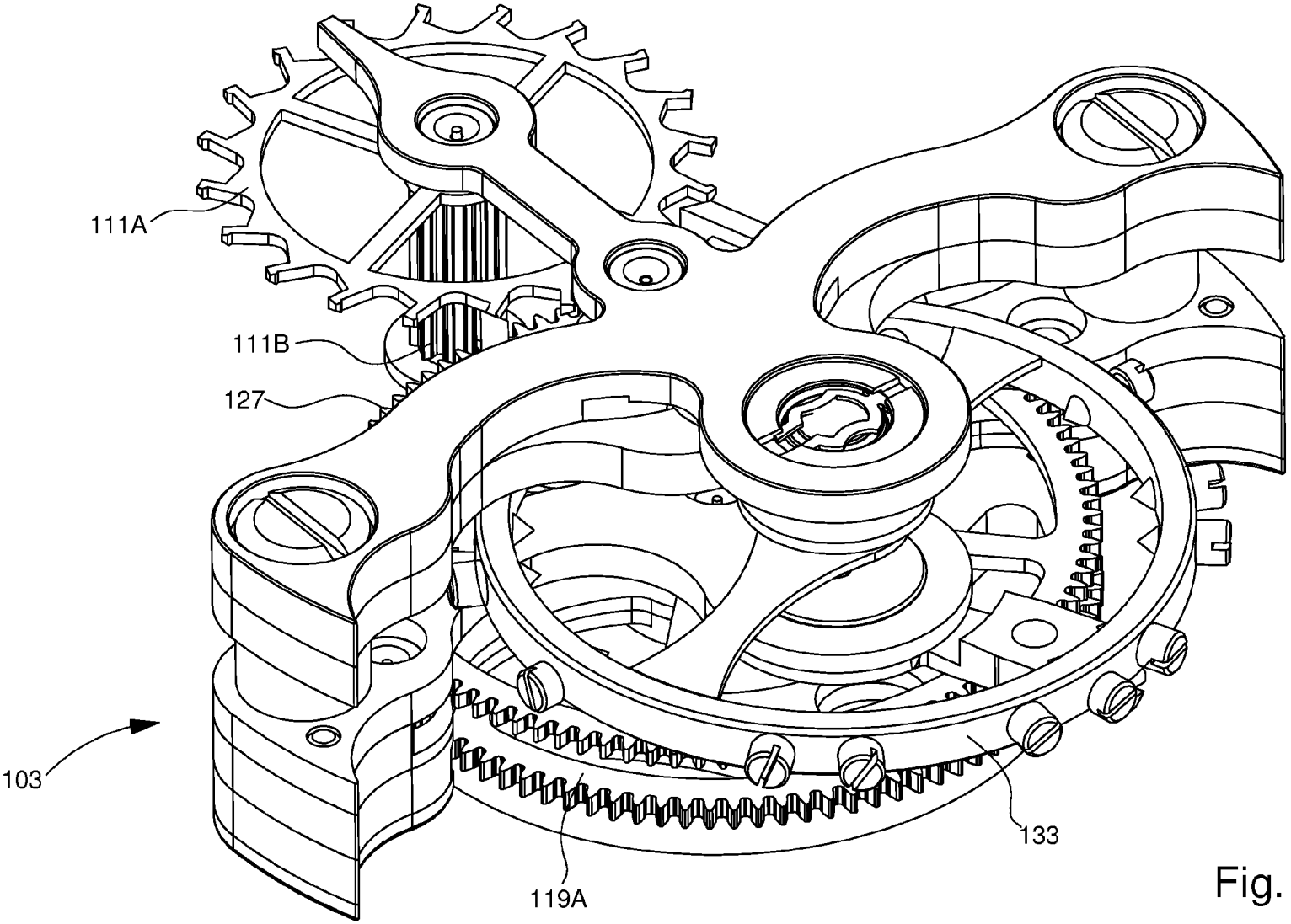
FIG. 5 is a partial perspective view of the fixed wheel and the carriage of FIGS. 3 and 4 with the carriage completely assembled.

FIG. 5 shows carriage 103 completely assembled. FIG. 5 shows in particular sprung balance 133.

Figure 6:
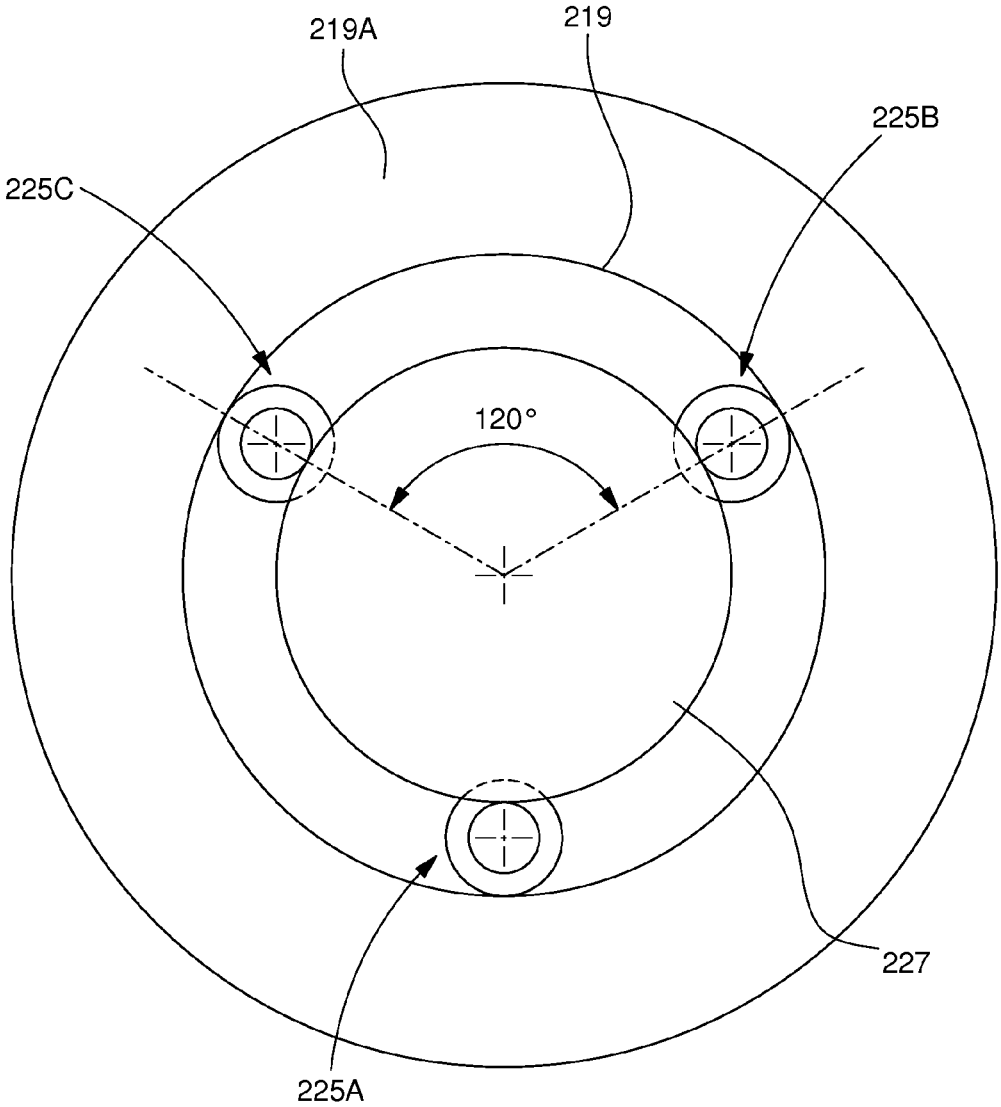
FIG. 6 is a schematic top view which shows the fixed toothing and the false fixed wheel, and also the gear that connects them to each other, according to a second embodiment of the invention.

It will also be clear that various alterations and/or improvements that are evident to those skilled in the art can be made to the embodiment forming the subject of this description without departing from the scope of the present invention defined by the annexed claims. In particular, the fixed toothing is not necessarily the toothing of a fixed wheel. Indeed, it is also possible to use, for example, the inner toothing of a crown integral with the frame for the fixed toothing. One embodiment using a fixed crown instead of a fixed wheel is partially illustrated in FIG. 6. FIG. 6 shows schematically a fixed crown 219A with an inner toothing 219, and a false fixed wheel 227 carried by the carriage (not shown). The tourbillon watch mechanism according to this second embodiment further includes three toothed elements 225A, 225B, 225C pivoting in the carriage and regularly spaced (every 120°) around the false fixed wheel 227. Toothed elements 225A, 225B and 225C are each formed of a first pinion of larger diameter and a second pinion of smaller diameter. The two pinions are assembled with one in the extension of the other. The first pinion of each set meshes with the inner toothing of the fixed crown and the second pinion meshes with the false fixed wheel. In the example illustrated, the ratio between the first and second pinion diameters is chosen to be equal to the ratio between the pitch radii of the fixed crown and the false fixed wheel.

According to the illustrated example, when the tourbillon mechanism is operating, the carriage rotates in the clockwise direction concentrically to the fixed crown and to the false fixed wheel. Again by way of example, the rotational speed of the carriage can be one revolution per minute. In these conditions, within the reference frame of the carriage, it can be said that, relative to the carriage, it is the fixed crown that rotates at a speed of one revolution per minute in the anti-clockwise direction. The rotation of the fixed crown relative to the carriage drives the three toothed elements 225A, 225B and 225C in the anti-clockwise direction. The three toothed elements in turn drive the false fixed wheel in the clockwise direction. Since the ratio between the pitch circumferences of the fixed toothing and the first pinion is equal to the ratio between the pitch circumferences of the false fixed wheel and the second pinion, the false fixed wheel rotates at a speed of one revolution per minute in the clockwise direction relative to the carriage. This means that, relative to the fixed crown, the false fixed wheel rotates at a speed of 2 revolutions per minute in the clockwise direction.

According to this second embodiment, the false fixed wheel therefore rotates in the clockwise direction relative to the carriage. In these conditions, the escape wheel set has to rotate in the opposite direction to the usual direction within a normal timepiece movement. However, those skilled in the art know how to make escapements that rotate in one direction or the other. They will not therefore encounter any particular difficult in making the tourbillon in this example. Moreover, one advantageous consequence of the pitch radius ratios used in the above example is that the balance and the escapement can operate at the same frequency as in a usual timepiece movement.

This second embodiment illustrates, in particular, the fact that, according to the invention, the speed of the false fixed wheel relative to the frame is not necessarily zero. The only requirement linked to the invention is that the false fixed wheel and the carriage rotate relative to each other. It will be clear, moreover, that said "at least two toothed elements regularly spaced around the toothed wheel" are not necessarily formed solely of pinions. They could equally well be a wheel and a pinion assembled to each other. Moreover, the toothed elements are not necessarily two or three in number. There could, for example, be four spaced at an angle of 90 degrees from each other.

What is claimed is:

1. A timepiece mechanism including an escapement including an escape wheel and pinion, and a sprung balance, the escapement and the sprung balance being mounted in a rotating carriage designed to pivot on a frame of a timepiece movement fitted with a driving barrel, and to be driven in rotation by said driving barrel, and further including a circular toothing, called the fixed toothing, designed to be fixed to the frame in a concentric position to the axis of rotation of the carriage, the escape pinion being designed to be connected to said fixed toothing by gearing, wherein the timepiece mechanism further includes a toothed wheel and at least two toothed elements pivoting in the carriage, said toothed wheel, which meshes with the escape pinion, being freely mounted in the carriage in a coaxial position, and said at least two toothed elements being regularly spaced around said toothed wheel with which said toothed elements mesh, said at least two toothed elements each being designed to also mesh with the fixed toothing so as to connect the escape pinion to the fixed toothing.

2. The timepiece mechanism according to claim 1, wherein the fixed toothing is formed by the toothing of a wheel fixed to the frame.

3. The timepiece mechanism according to claim 1, wherein the fixed toothing is formed by the inner toothing of a crown fixed to the frame.

4. The timepiece mechanism according to claim 2, wherein said toothed wheel and the wheel fixed to the frame have the same pitch diameter and in that the rotational speed of the toothed wheel relative to the frame is zero.

5. The timepiece mechanism according to claim 4, wherein said at least two toothed elements are pinions.

6. The timepiece mechanism according to claim 1, wherein said at least two toothed elements are two toothed elements occupying diametrically opposite positions around the toothed wheel.

7. The timepiece mechanism according to claim 1, wherein said at least two toothed elements are three toothed elements regularly spaced around the toothed wheel.

8. The timepiece movement including a driving barrel, an escapement including an escape wheel and pinion, and a sprung balance, the escapement and the sprung balance being mounted in a rotating carriage pivoting on a frame of the timepiece movement and kinematically connected to the driving barrel, such that the carriage can be driven in rotation, the escape pinion being connected via gearing to a fixed circular toothing integral with the frame, said fixed toothing being concentrically arranged with the axis of rotation of the carriage, wherein the gearing that connects the escape pinion to the fixed toothing includes a toothed wheel and at least two toothed elements pivoting in the carriage, said toothed wheel, which meshes with the escape pinion, being freely mounted in the carriage in a coaxial position, and said at least two toothed elements being regularly spaced around said toothed wheel with which said toothed elements mesh, said at least two toothed elements each meshing with the fixed toothing.

* * * * *